US009340996B2

(12) United States Patent
Nelson

(10) Patent No.: US 9,340,996 B2
(45) Date of Patent: May 17, 2016

(54) ADJUSTABLE STRIKE PLATE ASSEMBLIES AND SYSTEMS AND METHODS INCLUDING THE SAME

(71) Applicant: The Boeing Company, Seal Beach, CA (US)

(72) Inventor: James Burton Nelson, Everett, WA (US)

(73) Assignee: The Boeing Company, Chicago, IL (US)

( * ) Notice: Subject to any disclaimer, the term of this patent is extended or adjusted under 35 U.S.C. 154(b) by 233 days.

(21) Appl. No.: 13/909,812

(22) Filed: Jun. 4, 2013

(65) Prior Publication Data

US 2014/0353989 A1 Dec. 4, 2014

(51) Int. Cl.
*E05B 15/02* (2006.01)

(52) U.S. Cl.
CPC ..... *E05B 15/0245* (2013.01); *E05B 2015/0275* (2013.01); *Y10T 292/705* (2015.04)

(58) Field of Classification Search
CPC ..... Y10T 292/705; Y10T 292/707; Y10T 292/68; E05B 15/0245; E05B 15/024; E05B 15/025; E05B 2015/0275; Y10S 292/60; Y10S 292/55; E06B 1/603
USPC ..... 292/341.18, 341.19 X
See application file for complete search history.

(56) References Cited

U.S. PATENT DOCUMENTS

| | | | | | |
|---|---|---|---|---|---|
| 852,552 | A * | 5/1907 | Gabbert | G01G 23/22 | 177/29 |
| 872,053 | A * | 11/1907 | Christy | 292/341.18 | |
| 1,214,227 | A * | 1/1917 | Schwenk | 292/341.19 | |
| 1,272,115 | A * | 7/1918 | Russell | E05B 15/0245 | 292/341.19 |
| 1,913,986 | A * | 6/1933 | Harward | 292/341.18 | |
| 2,094,119 | A | 9/1937 | Flora | | |
| 2,695,808 | A * | 11/1954 | Manchester | 292/341.18 | |
| 2,798,754 | A * | 7/1957 | Russell | E05B 15/0245 | 292/341.18 |
| 7,011,348 | B2 | 3/2006 | Milo | | |
| 2006/0157991 | A1 | 7/2006 | Nguyen | | |
| 2012/0286527 | A1 * | 11/2012 | Mullet | 292/341.18 | |

* cited by examiner

*Primary Examiner* — Mark Williams
(74) *Attorney, Agent, or Firm* — Dascenzo Intellectual Property Law, P.C.

(57) ABSTRACT

Adjustable strike plate assemblies and systems and methods including the same are disclosed herein. The assemblies include a cover plate that defines a lock-facing side, an opposed striker-facing side, and a striker opening. The assemblies further include a striker that defines a bolt receptacle that is sized to receive a bolt of a lock. The bolt receptacle is aligned within the striker opening to define a bolt-receiving portion of the strike plate assembly. The assemblies further include an alignment structure that aligns the striker with the cover plate to define a plurality of orientations of the bolt receptacle relative to the striker opening. In operation, the striker-facing side of the cover plate generally faces toward the striker and the alignment structure. The assemblies further include a fastening structure that selectively retains the bolt receptacle in a selected orientation of the plurality of orientations.

20 Claims, 7 Drawing Sheets

ADJUSTABLE STRIKE PLATE ASSEMBLIES AND SYSTEMS AND METHODS INCLUDING THE SAME

FIELD

The present disclosure relates to an adjustable strike plate assembly and to systems and methods that include the adjustable strike plate assembly.

BACKGROUND

Lock assemblies often may include a lock, which is configured to extend and retract a bolt, and a strike plate, which defines a bolt receptacle that is configured to receive the bolt. Generally, the lock assembly may be utilized to secure a door of a compartment and/or an enclosure. Under these conditions, the lock may be operatively attached to one of the door and the compartment, and the strike plate may be operatively attached to the other of the door and the compartment. Thus, extension of the bolt from the lock into the bolt receptacle may limit motion of the door, thereby retaining the door in a desired (such as a closed) configuration.

Under certain conditions, it may be desirable to restrict and/or eliminate motion of the door when the door is retained in the desired configuration. As an illustrative, non-exclusive example, and when the lock assembly is utilized within a moving structure, such as an automobile, a ship, a recreational vehicle, and/or an aircraft, motion of the moving structure may cause the door to vibrate and/or make noise if the door is not securely retained in the desired position and/or if the door is able to move when in the desired position. As such, it may be desirable to maintain a tight tolerance, clearance, and/or spacing between the bolt and the bolt receptacle to reduce, restrict, and/or eliminate motion of the door.

As the clearance between the bolt and the bolt receptacle is decreased, accurate placement of the lock relative to the strike plate becomes increasingly important, as misalignment may preclude extension of the bolt into the bolt receptacle. Thus, it may be desirable to adjust a location of the bolt receptacle relative to the lock and/or bolt. While it is sometimes possible to adjust the location of the bolt receptacle of traditional strike plates, they may be difficult to adjust and/or may not provide a desired level of adjustment. Additionally or alternatively, an adjustment mechanism of the traditional strike plate may be easily damaged and/or may be susceptible to contamination by particulate material. Thus, and after the strike plate has been installed in a given location for a period of time, it may be difficult and/or impossible to adjust the strike plate. This is especially true for strike plates that are mounted on a floor, where particulate material often may collect. Thus, there exists a need for improved strike plate assemblies and/or for systems and methods including the same.

SUMMARY

Adjustable strike plate assemblies and systems and methods including the same are disclosed herein. The assemblies include a cover plate that defines a lock-facing side, an opposed striker-facing side, and a striker opening. The assemblies further include a striker that defines a bolt receptacle that is sized to receive a bolt of a lock. The bolt receptacle is aligned within the striker opening to define a bolt-receiving portion of the strike plate assembly. The assemblies further include an alignment structure that aligns the striker with the cover plate to define a plurality of orientations of the bolt receptacle relative to the striker opening. In operation, the striker-facing side of the cover plate generally faces toward the striker and the alignment structure. Thus, the cover plate shields the striker and the alignment structure from the lock-facing side thereof. The assemblies further include a fastening structure that selectively retains the bolt receptacle in a selected orientation of the plurality of orientations.

In some embodiments, the assemblies further may include a void space that is defined by the cover plate and the striker and that extends at least partially between the alignment structure and the bolt-receiving portion. In some embodiments, the striker defines a contact surface that extends across the striker opening, surrounds the bolt receptacle, and/or contacts the striker-facing side of the cover plate.

In some embodiments, the plurality of orientations permits selective translation of the striker relative to the cover plate in two directions. In some embodiments, the plurality of orientations includes a plurality of discrete orientations.

In some embodiments, the alignment structure includes a striker-facing alignment portion that is defined on the striker-facing side of the cover plate and a plate-facing alignment portion that is defined by the striker and interlocks with the striker-facing alignment portion. In some embodiments, the alignment portions include a plurality of interlocking serrations.

In some embodiments, the assembly further includes a back plate. In some embodiments, the fastening structure is configured to compress the striker between the back plate and the cover plate to retain the strike plate assembly in the selected orientation.

In some embodiments, the striker includes an orientation adjustment opening. In some embodiments, the fastening structure extends through the orientation adjustment opening. In some embodiments, the orientation adjustment opening is sized to permit the striker to translate relative to the fastening structure in a direction that is perpendicular to a longitudinal axis of the fastener.

DESCRIPTION

Figure 1:
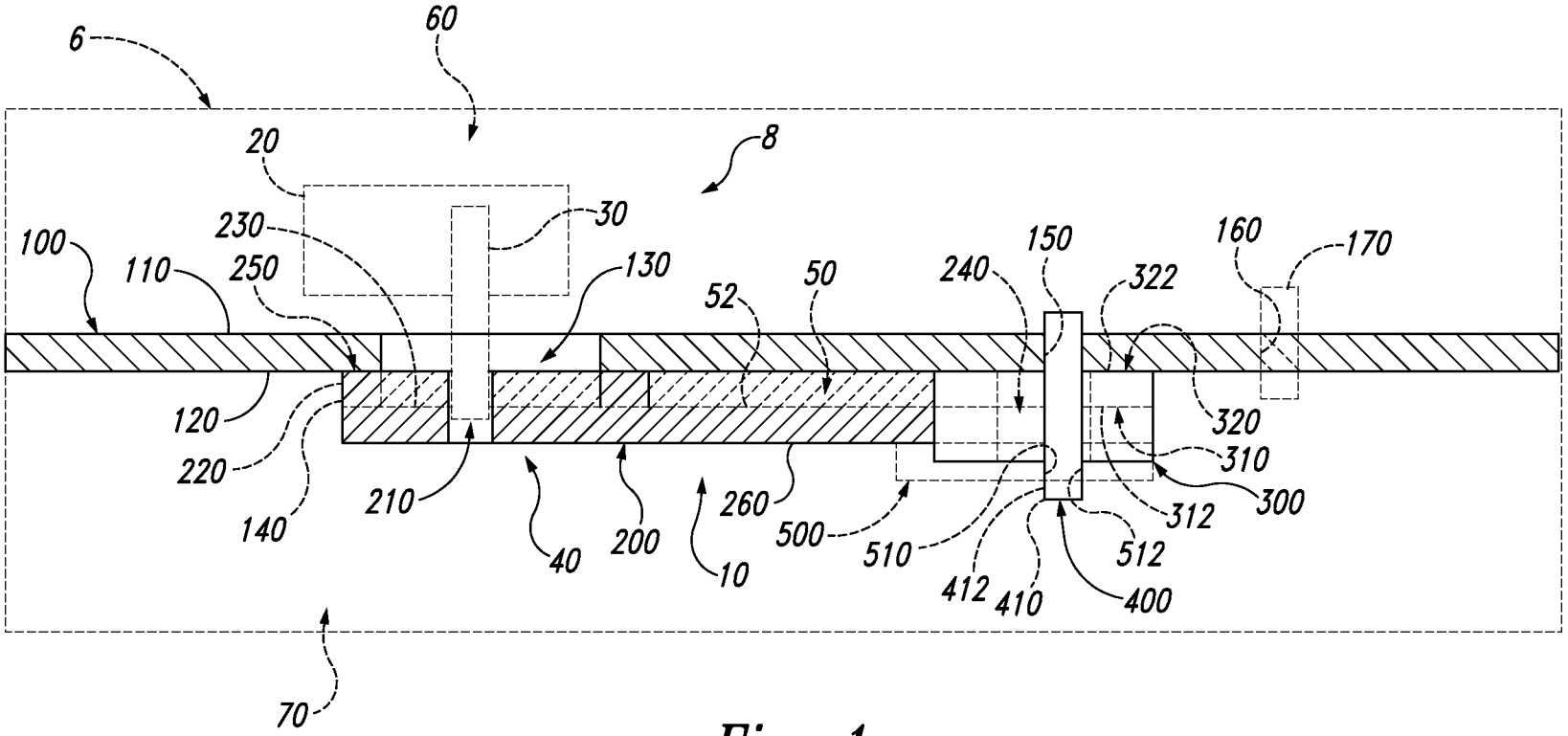
FIG. 1 is a schematic representation of illustrative, non-exclusive examples of a strike plate assembly according to the present disclosure.

FIGS. 1-7 provide illustrative, non-exclusive examples of strike plate assemblies 10 and/or components thereof according to the present disclosure. Strike plate assemblies 10 may be included in and/or utilized with any suitable lock assembly 8 and/or may be present in any suitable structure 6. Elements that serve a similar, or at least substantially similar, purpose are labeled with like numbers in each of FIGS. 1-7, and these elements may not be discussed in detail herein with reference to each of FIGS. 1-7. Similarly, all elements may not be labeled in each of FIGS. 1-7, but reference numerals associated therewith may be utilized herein for consistency. Elements, components, and/or features that are discussed herein with reference to one or more of FIGS. 1-7 may be included in and/or utilized with any of FIGS. 1-7 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic representation of illustrative, non-exclusive examples of a strike plate assembly 10 according to the present disclosure. Strike plate assembly 10 also may be referred to herein as an adjustable strike plate assembly 10 and is configured to receive a bolt 30 of a lock 20. Strike plate assembly 10 together with lock 20 may be referred to herein as a lock assembly 8 that may be configured to lock any suitable structure 6, such as a door.

Strike plate assembly 10 includes a cover plate 100 that defines a lock-facing side 110 and a striker-facing side 120, which may be opposed to lock-facing side 110 and also may be referred to herein as lock-opposed side 120. When strike plate assembly 10 forms a portion of lock assembly 8, lock-facing side 110 faces, generally faces toward, and/or is oriented toward lock 20, while striker-facing side 120 may face away from and/or may be oriented away from lock 20. Cover plate 100 further defines a striker opening 130 that extends between lock-facing side 110 and striker-facing side 120.

Strike plate assembly 10 also includes a striker 200. Striker 200 defines a bolt receptacle 210 that is adapted, configured, machined, fabricated, and/or sized to receive bolt 30. As illustrated in FIG. 1, striker opening 130 of cover plate 100 is larger (or has a greater cross-sectional area than) bolt receptacle 210 of striker 200. As an illustrative, non-exclusive example, a cross-sectional area of striker opening 130 (as defined in a plane that is parallel to striker-facing side 120) may be larger than a cross-sectional area of bolt receptacle 210 (as defined in a plane that is parallel to striker-facing side 120). As illustrative, non-exclusive examples, the cross-sectional area of striker opening 130 may be at least 2 times, at least 3 times, at least 4 times, at least 5 times, at least 6 times, at least 8 times, or at least 10 times larger than the cross-sectional area of bolt receptacle 210. Additionally or alternatively, the cross-sectional area of striker opening 130 also may be less than 20 times, less than 16 times, less than 12 times, less than 10 times, less than 8 times, or less than 6 times larger than the cross-sectional area of bolt receptacle 210. As also illustrated in FIG. 1, striker opening 130 of cover plate 100 permits access to bolt receptacle 210 by bolt 30.

Strike plate assembly 10 further includes an alignment structure 300 that is configured to align striker 200 with cover plate 100. As discussed in more detail herein, alignment structure 300 defines a plurality of orientations of striker 200 relative to cover plate 100. As illustrated in FIG. 1, bolt receptacle 210 is aligned within (and/or accessible to bolt 30 via) striker opening 130 to define a bolt-receiving portion 40 of strike plate assembly 10. Thus, alignment structure 300 additionally or alternatively may be referred to herein as defining a plurality of orientations of bolt receptacle 210 of striker 200 relative to striker opening 130 of cover plate 100. This plurality of orientations may permit adjustment of a location of bolt receptacle 210 to a desired location within, or relative to, striker opening 130, such as to permit alignment of bolt receptacle 210 with bolt 30 of lock 20.

As also illustrated in FIG. 1, striker-facing side 120 of cover plate 100 faces toward, or at least generally toward, both striker 200 and alignment structure 300. As such, striker 200 and alignment structure 300 additionally or alternatively may be referred to herein as being located on striker-facing side 120 of cover plate 100, as being separated from lock 20 by cover plate 100, and/or as being operatively attached to striker-facing side 120 of cover plate 100. Additionally or alternatively, cover plate 100 may be referred to herein as being located between lock 20 and striker 200, as being located between lock 20 and alignment structure 300, and/or as protecting and/or sealing striker 200 and/or alignment structure 300 from contaminate and/or particulate material that may be present on lock-facing side 110 of cover plate 100.

As an illustrative, non-exclusive example, and when strike plate assembly 10 and/or lock assembly 8 are located and/or mounted within structure 6, lock-facing side 110 may be open and/or exposed to an interior 60 of structure 6, while striker-facing side 120 may be located within a recess 70 that is defined by structure 6. As such, cover plate 100 may protect striker 200 and/or alignment structure 300 from damage due to impact with a body that may be present within interior 60 and/or from contamination by contaminate and/or particulate material that may be present within interior 60.

As also illustrated in FIG. 1, strike plate assembly 10 further includes a fastening structure 400. Fastening structure 400 is adapted, configured, designed, sized, and/or constructed to selectively retain striker 200 and/or bolt receptacle 210 thereof in a selected and/or desired orientation relative to cover plate 100 and/or striker opening 130 thereof. As an illustrative, non-exclusive example, and as discussed in more detail herein, fastening structure 400 may be configured to be loosened, such as to permit alignment of bolt receptacle 210 with bolt 30. Subsequently, fastening structure 400 may be tightened, such as to operatively attach striker 200 to cover plate 100, to retain bolt receptacle 210 in alignment with bolt 30, and/or retain bolt receptacle 210 in the selected and/or desired orientation relative to striker opening 130.

As illustrated in dashed lines in FIG. 1, strike plate assembly 10 further may include a back plate 500. Back plate 500 may be in contact with and/or operatively attached to a plate-opposed side 260 of striker 200. In addition, and as discussed in more detail herein, back plate 500 may form a portion of and/or cooperate with fastening structure 400 to retain bolt receptacle 210 in the selected, or desired, orientation relative to striker opening 130.

As illustrated in dashed lines in FIG. 1, strike plate assembly 10 further may define a void space 50. Void space 50, when present, may be at least partially defined by cover plate 100 and/or may be at least partially defined by striker 200. Additionally or alternatively, and as illustrated, void space 50 may extend, at least partially, between alignment structure 300 and bolt-receiving portion 40 of strike plate assembly 10. As such, void space 50 may separate alignment structure 300 from bolt-receiving portion 40 and may be oriented, sized, and/or configured to decrease a potential for contamination of alignment structure 300 by contaminants and/or particulate matter that may collect within striker opening 130, may pass through bolt receptacle 210, and/or may pass through striker opening 130 and between striker-facing side 120 of cover plate 100 and a plate-facing side 250 of striker 200.

Void space 50 may be defined by strike plate assembly 10 in any suitable manner. As an illustrative, non-exclusive example, cover plate 100 and/or striker 200 may define a material relief section, or region, 52 that defines void space 50. As another illustrative, non-exclusive example, alignment structure 300 may include a striker-facing alignment portion 310 that extends from striker-facing side 120 of cover plate 100 and spaces a portion of striker 200 apart from a portion of cover plate 100 to define void space 50. As yet another illustrative, non-exclusive example, alignment structure 300 may include a plate-facing alignment portion 320 that extends from plate-facing side 250 of striker 200 and spaces a portion of striker 200 apart from a portion of cover plate 100 to define void space 50. As another illustrative, non-exclusive example, striker 200 may define a striker extension region 220 that extends from plate-facing side 250 of striker 200 and spaces a portion of striker 200 apart from a portion of cover plate 100 to define void space 50. As yet another illustrative, non-exclusive example, cover plate 100 may define a cover plate extension region 140 that extends from striker-facing side 120 of cover plate 100 and spaces a portion of striker 200 apart from a portion of cover plate 100 to define void space 50.

As also illustrated in dashed lines in FIG. 1, striker 200 further may define a contact surface 230 that is sized to extend (partially or entirely) across striker opening 130 (or across a portion of striker opening 130 that is defined by striker-facing side 120 of cover plate 100). Contact surface 230 further may be sized, shaped, and/or located to surround and/or to define a portion of bolt receptacle 210 and/or may contact (or mechanically contact) striker-facing side 120 of cover plate 100. Thus, contact surface 230 may increase a rigidity of strike plate assembly 10 when bolt receptacle 210 is retained in the selected orientation. Additionally or alternatively, contact surface 230 also may resist motion of contaminant and/or particulate material through striker opening 130 and between striker 200 and striker-facing side 120 of cover plate 100.

Alignment structure 300 may include any suitable structure that may be configured to align, or selectively align, striker 200 with cover plate 100 in the plurality of orientations. As an illustrative, non-exclusive example, alignment structure 300 may be designed, configured, and/or fabricated to permit selective translation of striker 200 relative to cover plate 100 in two different and/or (at least substantially) perpendicular directions, with these two directions also being referred to herein as a first direction and a second direction. Both the first direction and the second direction may be at least substantially parallel to a plane that is defined by striker-facing side 120 of cover plate 100. Thus, translation of striker 200 in the first direction and/or the second direction may permit adjustment of the location of bolt receptacle 210 within and/or relative to striker opening 130 in both the first direction and the second direction.

It is within the scope of the present disclosure that alignment structure 300 may be configured to permit continuous adjustment of the location of bolt receptacle 210 relative to (or within) striker opening 130. Under these conditions, the plurality of orientations also may be referred to herein as an infinite number of orientations and/or as a continuous distribution of orientations. However, it is also within the scope of the present disclosure that alignment structure 300 may be configured for discrete adjustment of the location of bolt receptacle 210 relative to (or within) striker opening 130. Under these conditions, the plurality of orientations also may be referred to herein as a plurality of discrete orientations.

As an illustrative, non-exclusive example, alignment structure 300 may include striker-facing alignment portion 310, which may be defined on striker-facing side 120 of cover plate 100. In addition, alignment structure 300 also may include plate-facing alignment portion 320, which may be defined by striker 200 (and/or on plate-facing side 250 thereof). Striker-facing alignment portion 310 and plate-facing alignment portion 320 may be adapted, configured, sized, shaped, and/or constructed to interlock with one another to define the plurality of orientations of striker 200 (or bolt receptacle 210 thereof) relative to cover plate 100 (or striker opening 130 thereof).

As a more specific but still illustrative, non-exclusive example, striker-facing alignment portion 310 may include and/or define a plurality of cover plate serrations 312, and plate-facing alignment portion 320 may include and/or define a plurality of complementary striker serrations 322 that are adapted, configured, sized, shaped, and/or constructed to interlock with the plurality of cover plate serrations 312 to define the plurality of relative orientations. Serrations 312/322 may include and/or be triangular serrations, linear serrations, and/or parallel serrations, and it is within the scope of the present disclosure that a first portion of the plurality of cover plate serrations 312 and a first portion of the plurality of striker serrations may be oriented in and/or aligned with the first direction, while a second portion of the plurality of cover plate serrations and a second portion of the plurality of striker serrations may be oriented in and/or aligned with the second direction, as illustrated in FIGS. 2-3 and 6-7 and discussed herein. This may permit selective and/or discrete adjustment of the orientation of striker 200 relative to cover plate 100 in both the first direction and the second direction.

Figure 2:
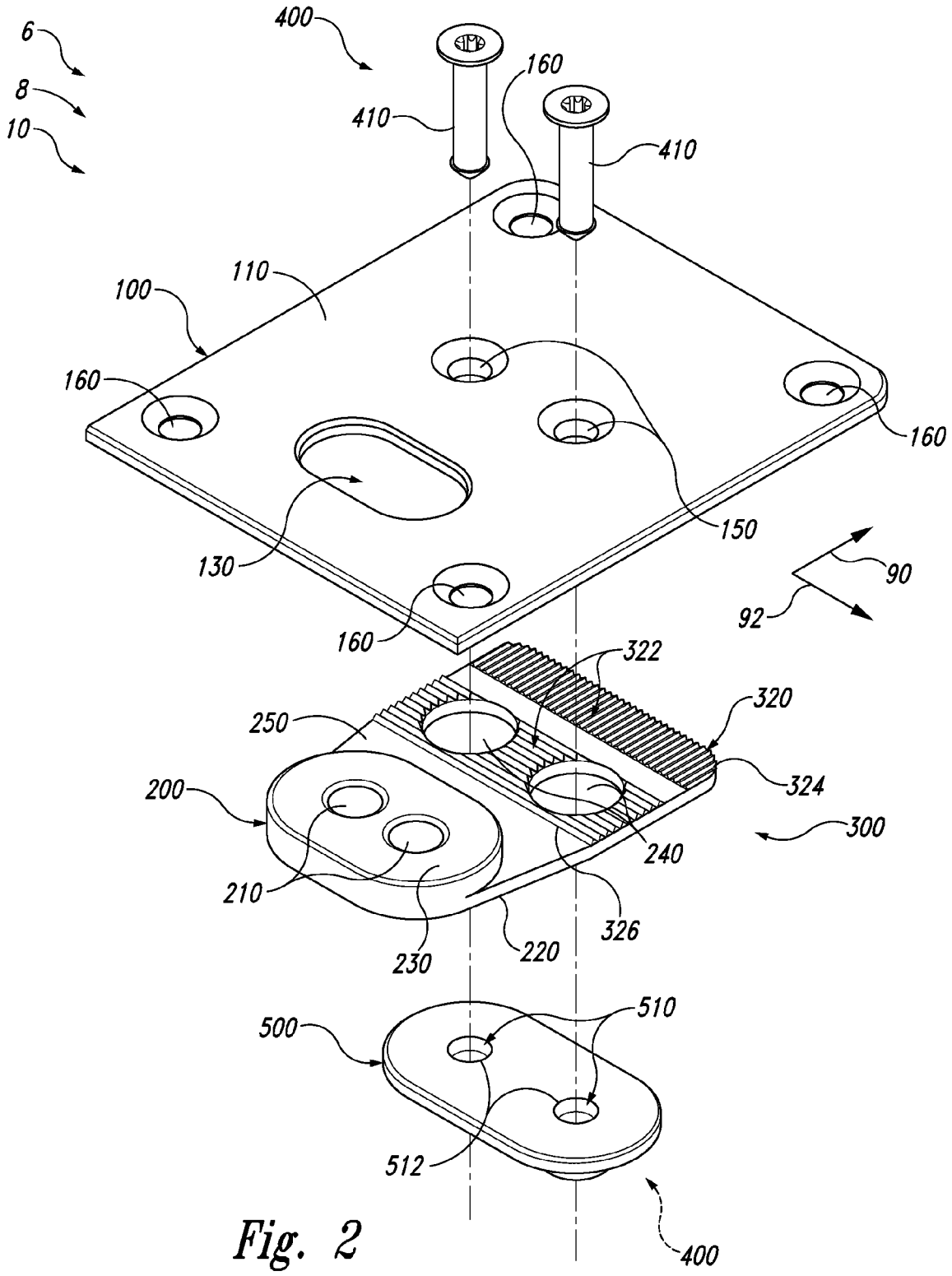
FIG. 2 is an exploded isometric view from a lock-facing side of a less schematic but still illustrative, non-exclusive example of a strike plate assembly according to the present disclosure.
Figure 3:
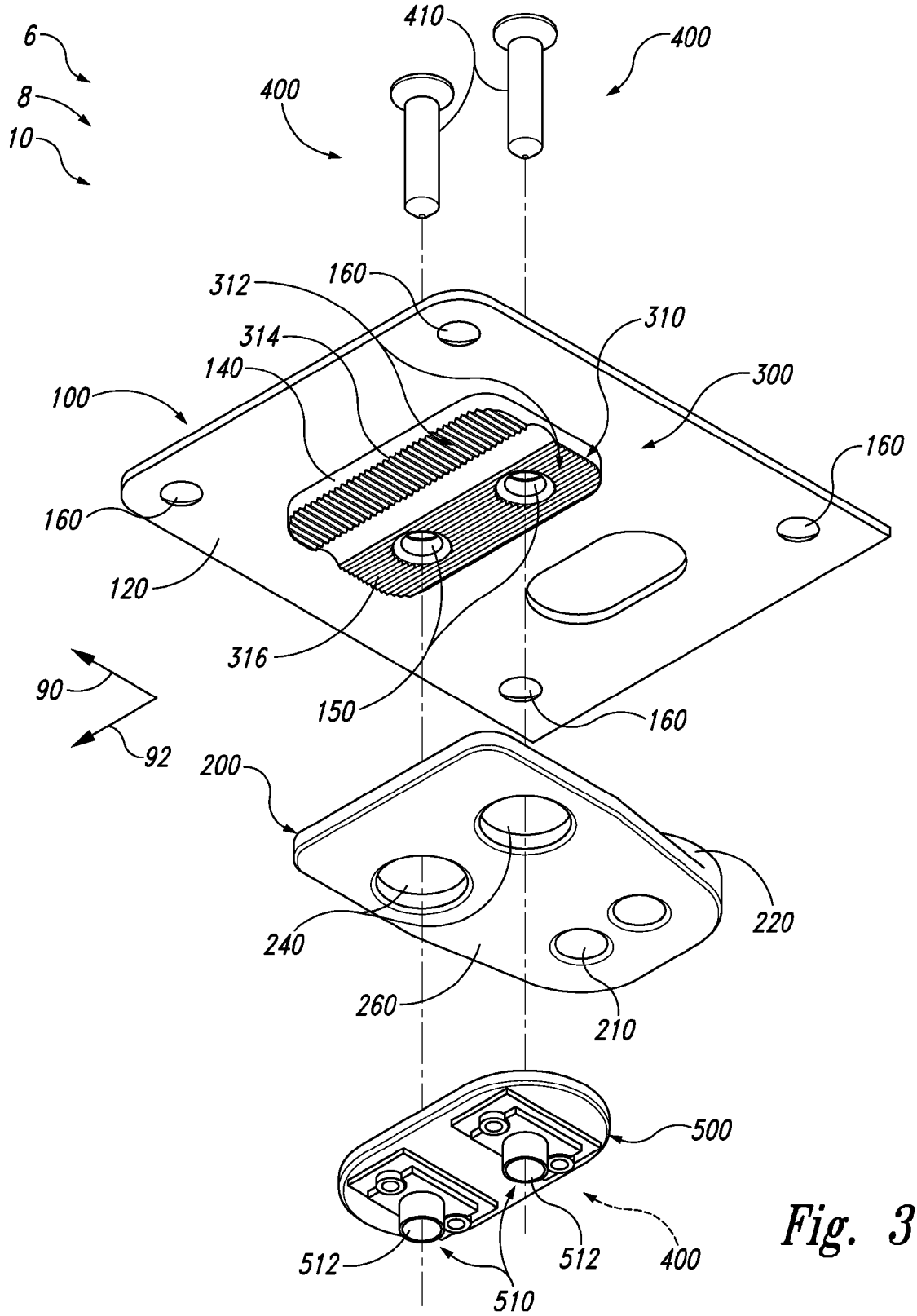
FIG. 3 is an exploded isometric view from a striker-facing (or lock-opposed) side of the strike plate assembly of FIG. 2.
Figure 6:
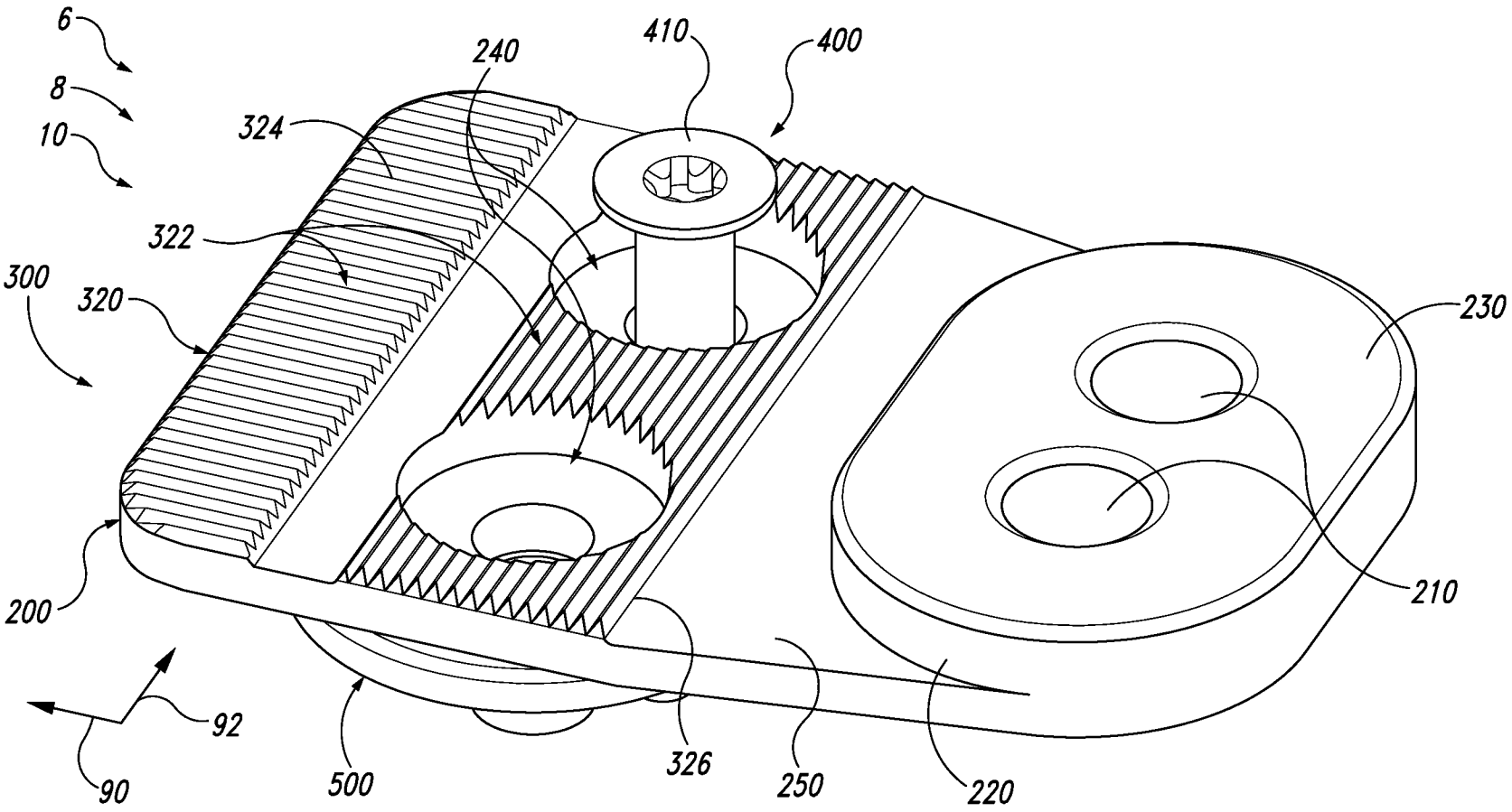
FIG. 6 is an isometric view of a plate-facing side of a striker according to the present disclosure that may be utilized with the strike plate assembly of FIGS. 2-5.
Figure 7:
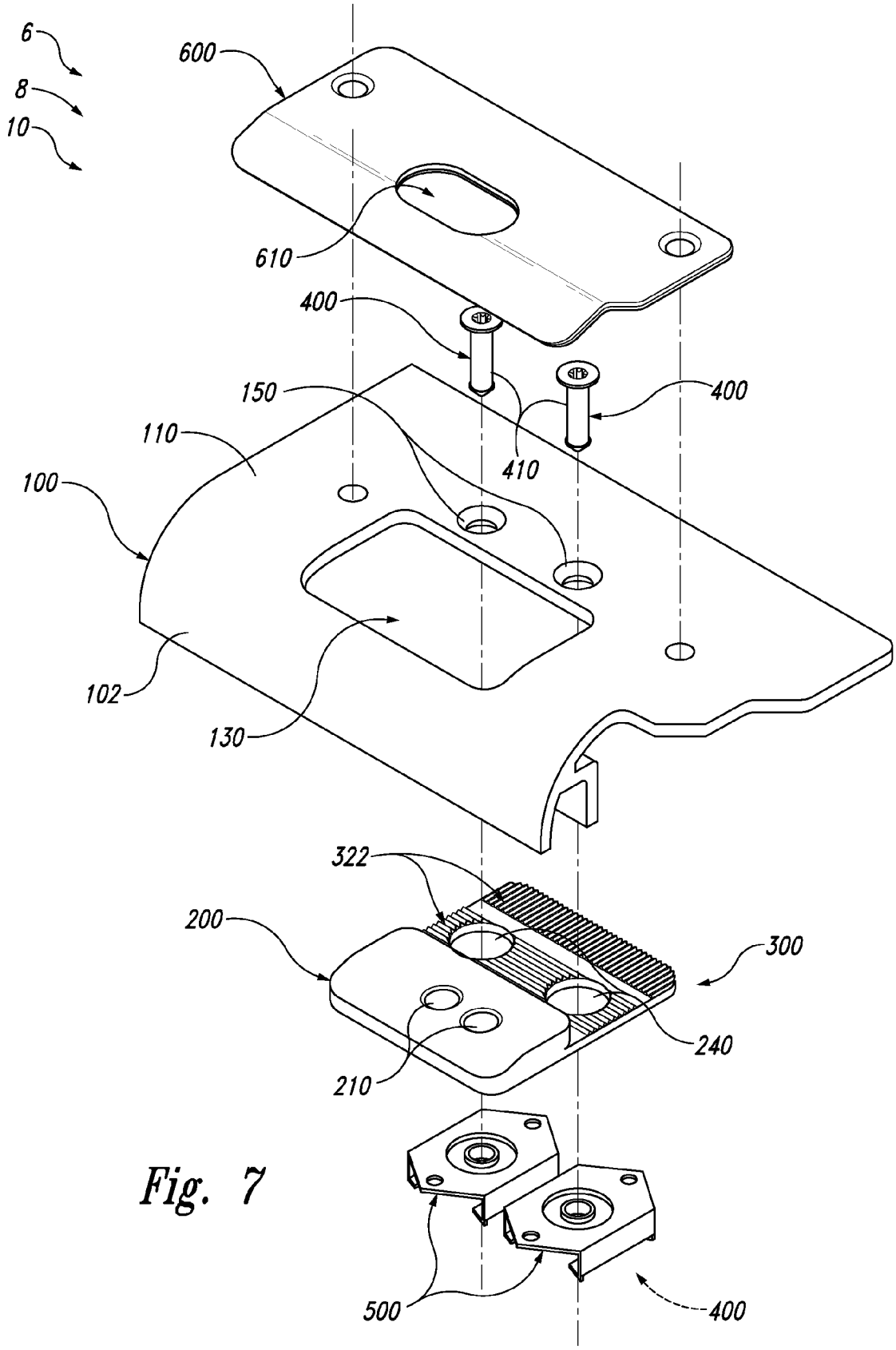
FIG. 7 is an exploded isometric view from a lock-facing side of another less schematic but still illustrative, non-exclusive example of a strike plate assembly according to the present disclosure.

As illustrated in FIG. 3, the first portion of the plurality of cover plate serrations 312 may be spaced apart from the second portion of the plurality of cover plate serrations 312. Similarly, and as illustrated in FIGS. 2 and 6-7, the first portion of the plurality of striker serrations 322 may be spaced apart from the second portion of the plurality of striker serrations 322.

As illustrated in FIG. 1, alignment structure 300 may be spaced apart from bolt-receiving portion 40. This may include being spaced apart by void space 50 and/or having void space 50 located therebetween, as discussed. The space between alignment structure 300 and bolt-receiving portion 40 further may decrease a potential for contamination of alignment structure 300 by contaminants and/or particulate material that may pass through striker opening 130, may pass through bolt receptacle 210, and/or may enter recess 70 from interior 60 (when bolt receptacle 210 forms a portion of structure 6).

It is within the scope of the present disclosure that alignment structure 300 and bolt-receiving portion 40 may be spaced apart in any suitable manner and/or direction. As illustrative, non-exclusive examples, alignment structure 300 and bolt-receiving portion 40 may be spaced apart from one another in a single direction and/or alignment structure 300 may be located on, or to, one side of bolt-receiving portion 40. As another illustrative, non-exclusive example, alignment structure 300 may not surround bolt-receiving portion 40.

Back plate 500 may include any suitable structure that may be operatively attached to and/or in contact with plate-opposed side 260 of striker 200 and/or that may be configured to cooperate with, or form a portion of, fastening structure 400. As an illustrative, non-exclusive example, fastening structure 400 may include a fastener 410, and back plate 500 may be configured to receive fastener 410 to compress striker 200 between the back plate and cover plate 100 and/or to retain strike plate assembly 10 in the selected orientation. As another illustrative, non-exclusive example, back plate 500 also may include and/or be operatively attached to a fastener receptacle 510 that is configured to receive fastener 410. As yet another illustrative, non-exclusive example, fastener 410 may include and/or be a threaded fastener 412 and back plate 500 may include a threaded receptacle 512 that is sized to receive threaded fastener 412.

Striker 200 may include any suitable structure that may define at least bolt receptacle 210 and/or that may be operatively attached to striker-facing side 120 of cover plate 100. As illustrated in FIG. 1, striker 200 further may define an orientation adjustment opening 240, and fastening structure 400 (and/or fastener 410 thereof) may be configured to extend through orientation adjustment opening 240 and/or between cover plate 100 and back plate 500. Orientation adjustment opening 240 may be sized to permit striker 200 to translate relative to fastening structure 400 in a direction that is perpendicular to a longitudinal axis of fastening structure 400 and/or in a direction that is parallel to a plane that is defined by striker-facing side 120 of cover plate 100. Thus, and when striker 200 is not operatively attached to cover plate 100 and/or compressed between cover plate 100 and back plate 500, orientation adjustment opening 240 may permit striker 200 to translate relative to fastening structure 400, cover plate 100, and/or back plate 500 to transition among the plurality of orientations that may be defined between bolt receptacle 210 and striker opening 130.

As discussed, bolt receptacle 210 may be sized to receive and/or retain bolt 30 when bolt 30 is aligned with bolt receptacle 210 and extended from lock 20 into bolt receptacle 210. As also discussed, a clearance, tolerance, and/or spacing for bolt 30 within bolt receptacle 210 may be relatively tight, or precise, such as to permit utilization of lock assembly 8 within structure 6 without rattling and/or vibration of lock assembly 8. As illustrative, non-exclusive examples, a clearance, or spacing, between bolt 30 and bolt receptacle 210 when the bolt is located within the bolt receptacle may be less than a threshold fraction of a transverse cross-sectional diameter (or other characteristic dimension) of bolt receptacle 210. Illustrative, non-exclusive examples of the threshold fraction include threshold fractions of less than 25%, less than 20%, less than 15%, less than 10%, or less than 5% of the transverse cross-sectional diameter of bolt receptacle 210.

FIG. 1 illustrates lock assembly 8 as including a single lock 20 that includes a single bolt 30 and further illustrates striker 200 as defining a single bolt receptacle 210. However, it is within the scope of the present disclosure that strikers 200 and/or strike plate assemblies 10 according to the present disclosure may define any suitable number of bolt receptacles 210, including 2, 3, 4, 5, or more than 5 bolt receptacles 210. As an illustrative, non-exclusive example, lock 20 may include a plurality of bolts 30 and strike plate assembly 10 may include a corresponding number of bolt receptacles 210. As another illustrative, non-exclusive example, lock assembly 8 may include a plurality of locks 20, each of which may include at least one bolt 30, and strike plate assembly 10 may be configured to receive each bolt 30 that may be associated with each of the plurality of locks 20.

Cover plate 100 may include any suitable structure that defines lock-facing side 110, striker-facing side 120, and striker opening 130. In addition, and as illustrated in dashed lines in FIG. 1, cover plate 100 also may define a fastener opening 150. Fastener opening 150 may extend between lock-facing side 110 and striker-facing side 120 and may be sized to permit fastening structure 400 and/or fastener 410 thereof to extend therethrough. Additionally or alternatively, cover plate 100 also may define a mounting opening 160. Similar to fastener opening 150 and/or striker opening 130, mounting opening 160 may extend between lock-facing side 110 and striker-facing side 120. Mounting opening 160 may be sized and/or configured to receive a mounting device 170, such as a mounting fastener, that may permit strike plate assembly 10 to be mounted within and/or operatively attached to structure 6.

Lock assembly 8 and/or any suitable component thereof, such as cover plate 100, striker 200, alignment structure 300, fastening structure 400, and/or back plate 500 may be formed from any suitable material. As illustrative, non-exclusive examples, one or more components of lock assembly 8 may be formed from any suitable metal, metallic material, metal alloy, aluminum, steel, stainless steel, polymer, polymeric material, composite material, organic material, and/or inorganic material.

As discussed, lock assembly 8 may be utilized to retain a door that may be associated with structure 6. It is within the scope of the present disclosure that structure 6 further may include and/or a define a compartment, with the door selectively providing access to the compartment via actuation of lock assembly 8, lock 20, and/or bolt 30 thereof. It is further within the scope of the present disclosure that structure 6 may include and/or be any suitable moving structure, vehicle, vessel, automobile, ship, recreational vehicle, and/or aircraft.

Strike plate assembly 10 may be located, mounted, and/or oriented in any suitable manner within structure 6. As an illustrative, non-exclusive example, strike plate assembly 10 may be mounted on a threshold, such as a threshold to a doorway. As another illustrative, non-exclusive example, strike plate assembly 10 may be mounted on a jamb, such as a door jamb, side jamb, and/or head jamb. As yet another illustrative, non-exclusive example, strike plate assembly 10 may be located and/or mounted on, or near, a floor. As another illustrative, non-exclusive example, strike plate assembly 10 may be mounted in a horizontal orientation and/or may be mounted such that a plane that is defined by lock-facing side 110 of cover plate 100 is at least substantially parallel to a horizontal direction. Regardless of the specific configuration of strike plate assembly 10, and as discussed, cover plate 100 may restrict and/or prevent damage to and/or contamination of alignment structure 300, thereby permitting operation and/or adjustment of strike plate assembly 10 throughout a service life of structure 6.

FIGS. 2-6 provide less schematic but still illustrative, non-exclusive examples of a strike plate assembly 10 and/or components thereof according to the present disclosure. The numbering scheme of FIG. 1 is utilized in FIGS. 2-6; and elements, components, and/or features that are illustrated and/or discussed herein with reference to FIG. 1 may not be discussed in detail herein with reference to FIGS. 2-6. FIGS. 2-6 provide alternative and/or less schematic illustrations of the various elements, components, and/or features that comprise strike plate assembly 10 and/or of the interrelations therebetween, and a portion of these interrelations is discussed herebelow. Strike plate assembly 10 of FIGS. 2-5 includes a cover plate 100, a striker 200, an alignment structure 300, a fastening structure 400, and a back plate 500.

As illustrated, cover plate 100 defines a plurality of fastener openings 150, a plurality of mounting openings 160, and a striker opening 130. In addition, back plate 500 includes and/or defines a plurality of fastener receptacles 510 that may include and/or be a plurality of threaded receptacles 512. Fastening structure 400 includes a plurality of fasteners 410 that are configured to extend through fastener openings 150 of cover plate 100, through a plurality of orientation adjustment openings 240 of striker 200, and be received within fastener receptacles 510 of back plate 500 to retain striker 200 between cover plate 100 and back plate 500.

Striker 200 defines a plurality of bolt receptacles 210 and the plurality of orientation adjustment openings 240. Striker 200 also defines a striker extension region 220, which extends from a plate-facing side 250 thereof, and a contact surface 230, which is sized to extend across striker opening 130 of cover plate 100.

As perhaps illustrated most clearly in FIGS. 2 and 6, alignment structure 300 includes a plate-facing alignment portion 320 that is defined on plate-facing side 250 of striker 200. Plate-facing alignment portion 320 includes a plurality of striker serrations 322 in the form of a plurality of linear and/or triangular striker serrations 322. A first portion 324 of the plurality of striker serrations 322 is oriented in a first direction 90, while a second portion 326 of the plurality of striker serrations 322 is oriented in a second direction 92 that is at least substantially perpendicular to first direction 90. As discussed, the plurality of striker serrations permits adjustment of the orientation of striker 200 (or bolt receptacles 210 thereof) relative to cover plate 100 (or striker opening 130 thereof) in both first direction 90 and second direction 92.

As perhaps illustrated most clearly in FIG. 3, alignment structure 300 includes a striker-facing alignment portion 310 that is defined on and/or extends from striker-facing side 120 of cover plate 100. Striker-facing alignment portion 310 includes a plurality of cover plate serrations 312 in the form of a plurality of linear and/or triangular cover plate serrations 312 that are configured to be received by and/or interlock with the plurality of striker serrations 322 of striker 200. A first portion 314 of the plurality of cover plate serrations 312 is oriented in first direction 90, while a second portion 316 of the plurality of cover plate serrations 312 is oriented in second direction 92. As also illustrated in FIG. 3, back plate 500 may be a multi-piece structure, with fastener receptacles 510 and/or threaded receptacles 512 being operatively attached thereto.

Figure 4:
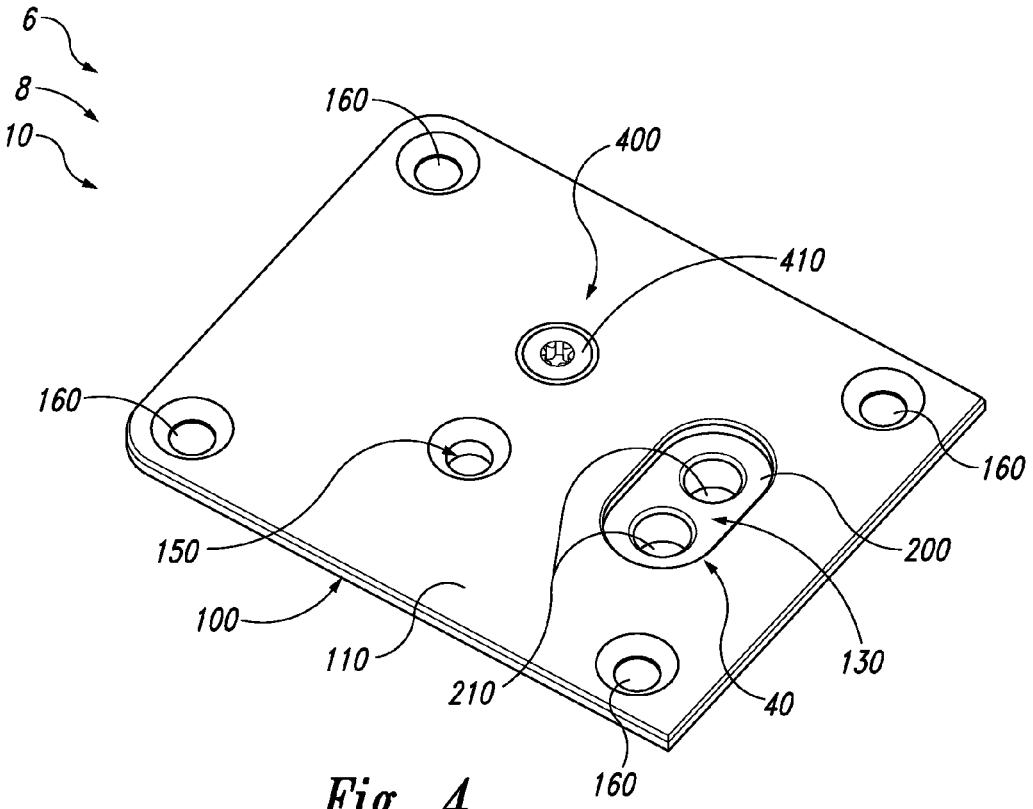
FIG. 4 is an assembled isometric view from the lock-facing side of the strike plate assembly of FIGS. 2-3.

As perhaps illustrated most clearly in FIG. 4, a bolt-receiving portion 40 of strike plate assembly 10 is defined by striker opening 130 and bolt receptacles 210. As illustrated, bolt receptacles 210 are aligned with, located within, accessible to the bolt via and/or accessible from bolt-facing side 110 of cover plate 100 via striker opening 130 of cover plate 100. In addition, adjustment of the orientation of striker 200 (such as by loosening fastening structure 400 and translating striker 200 relative to cover plate 100) permits adjustment of the location, or relative location, of bolt receptacles 210 within, or with respect to, striker opening 130, as discussed herein.

Figure 5:
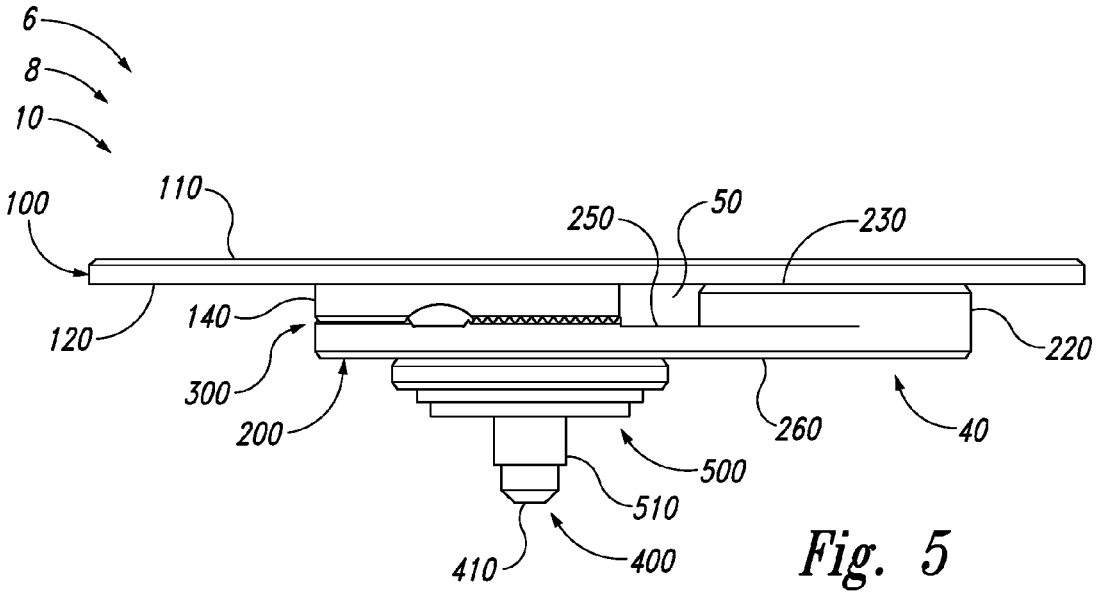
FIG. 5 is an assembled side view of the strike plate assembly of FIGS. 2-4.

As perhaps illustrated most clearly in FIG. 5, cover plate 100 defines a cover plate extension region 140 and striker 200 defines a striker extension region 220. Cover plate extension region 140 and striker extension region 220 space a portion of striker 200 apart from a portion of cover plate 100, thereby producing a void space 50 between bolt-receiving portion 40 and alignment structure 300. As discussed, void space 50 may decrease a potential for contamination of alignment structure 300 by contaminants and/or by particulate material.

As perhaps illustrated most clearly in FIG. 6, orientation adjustment openings 240 of striker 200 are sized to permit translation and/or motion of striker 200 relative to fastening structure 400 (or fastener 410 thereof) in a directly that is perpendicular to a longitudinal axis of the fastening structure 400. This further may permit translation of striker 200 (and/or bolt receptacles 210 thereof) to a selected orientation relative to cover plate 100 (and/or striker opening 130 thereof) without striker 200 contacting fastening structure 400 and/or without fastening structure 400 limiting the motion of striker 200.

FIG. 7 is an exploded isometric view from a lock-facing side 110 of another less schematic but still illustrative, non-exclusive example of a strike plate assembly 10 according to the present disclosure. Strike plate assembly 10 of FIG. 7 is similar to strike plate assembly 10 of FIGS. 1-6, and like numbers are utilized to designate like structures therein. However FIG. 7 illustrates that cover plate 100 may not be planar and/or may include a curved region 102. Curved region 102 may permit a bolt to slide across a surface thereof prior to being received within bolt receptacles 210. As an illustrative, non-exclusive example, and with reference to FIG. 1, bolt 30 may be biased to extend from lock 20 and only may be retracted into lock 20 through actuation of the lock. Under these conditions, and should a door that is attached to lock 20 be oriented such that bolt 30 is aligned with bolt receptacle 210, the bolt may extend automatically into the bolt receptacle.

FIG. 7 further illustrates that strike plate assembly 10 may include a plurality of back plates 500. In FIG. 7, strike plate assembly 10 includes two back plates 500, one for each fastener 410 of fastening structure 400. However, it is within the scope of the present disclosure that strike plate assembly 10 may include any suitable number of back plates 500, such as a separate back plate for each fastener 410 thereof.

FIG. 7 also illustrates that strike plate assembly 10 further may include a top plate 600 that extends across and/or covers at least a portion of cover plate 100. Top plate 600 may define a restricted striker opening 610 that is smaller than (or defines a smaller cross-sectional area than) striker opening 130 of cover plate 100.

Figure 8:
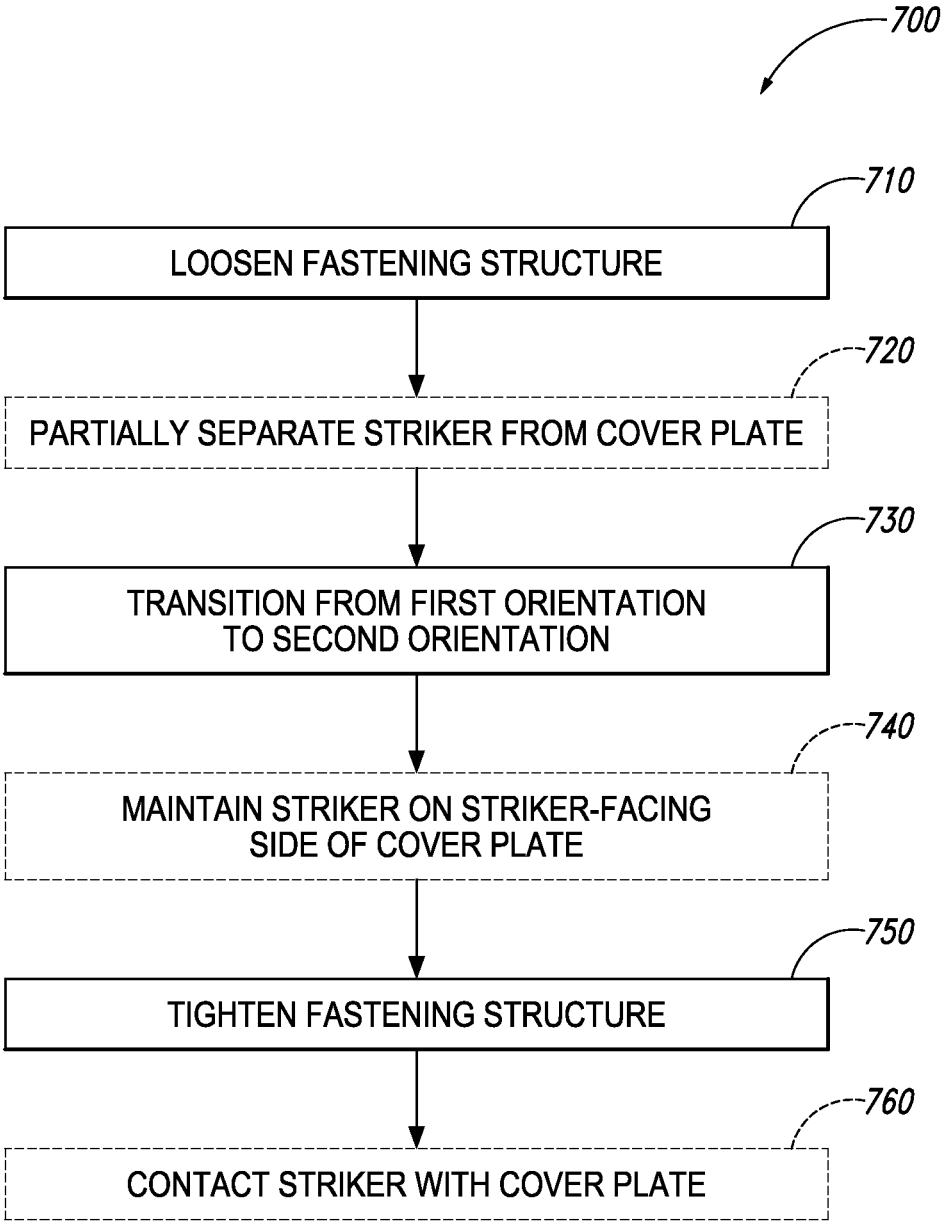
FIG. 8 is a flowchart depicting methods of adjusting a location of a bolt receptacle of a strike plate assembly according to the present disclosure.

FIG. 8 is a flowchart depicting methods 700 of adjusting a location of a bolt receptacle of a strike plate assembly according to the present disclosure (such as strike plate assembly 10 of FIGS. 1-7). Methods 700 include loosening a fastening structure at 710 and may include at least partially separating a striker from a cover plate at 720. Methods 700 further include transitioning a bolt receptacle of the striker from a first orientation relative to a striker opening of a cover plate to a second orientation relative to the striker opening of the cover plate at 730 and may include maintaining the striker on a striker-facing side of the cover plate at 740. Methods 700 further include tightening the fastening structure at 750 and may include contacting the striker with the cover plate at 760.

Loosening the fastening structure at 710 may include loosening the fastening structure in any suitable manner to permit motion of the striker relative to the cover plate. As an illustrative, non-exclusive example, the loosening at 710 may include removing the fastening structure from the strike plate assembly. As another illustrative, non-exclusive example, the fastening structure may include a threaded fastener and the loosening at 710 may include rotating the threaded fastener. As yet another illustrative, non-exclusive example, the loosening at 710 may include and/or produce the at least partially separating at 720.

At least partially separating the striker from the cover plate at 720 may include creating any suitable space and/or gap between the striker and the cover plate. As an illustrative, non-exclusive example, the separating at 720 may include creating the gap between a striker-facing side of the cover plate and the striker (or a plate-facing side of the striker). As another illustrative, non-exclusive example, the strike plate assembly may include an alignment structure that aligns the striker relative to the cover plate. A plate-facing alignment portion of the alignment structure may be defined by the striker and a striker-facing alignment portion of the alignment structure may be defined by the cover plate. The plate-facing alignment portion and the striker-facing alignment portion may be configured to interlock with one another to retain the bolt receptacle in a selected orientation relative to the striker opening, and the separating at 720 may include separating the plate-facing alignment portion from the striker-facing alignment portion.

Transitioning the bolt receptacle of the striker from the first orientation relative to the striker opening of the cover plate to the second orientation relative to the striker opening of the cover plate at 730 may be accomplished in any suitable manner. As an illustrative, non-exclusive example, the transitioning at 730 may include accessing and/or contacting the striker from the lock-facing side of the cover plate and/or through the striker opening of the cover plate. As another illustrative, non-exclusive example, the transitioning at 730 also may include providing a motive force for the transitioning, such as by pushing and/or pulling on the striker plate.

Maintaining the striker on the striker-facing side of the cover plate at 740 may include maintaining the striker on the striker-facing side of the cover plate during methods 700, during the loosening at 710, during the separating at 720, during the transitioning at 730 during the tightening at 750, and/or during the contacting at 760. Thus, the striker may remain on the striker-facing side of the cover plate and/or may be shielded and/or protected from the lock-facing side of the cover plate prior to, during, and/or subsequent to performing methods 700.

Tightening the fastening structure at 750 may include tightening the fastening structure in any suitable manner. This may include tightening the fastening structure to retain the bolt receptacle in the second orientation (subsequent to the transitioning at 730), tightening the fastening structure by re-inserting the fastening structure into the strike plate assembly, tightening the fastening structure by rotating the fastening structure, and/or tightening the fastening structure to produce and/or generate the contacting at 760.

Contacting the striker with the cover plate at 760 may include contacting at least a portion of the striker with at least a portion of the striker-facing side of the cover plate. As an illustrative, non-exclusive example, the contacting at 760 may include decreasing and/or eliminating the gap between the striker-facing side of the cover plate and the striker (or the plate-facing side of the striker). As another illustrative, non-exclusive example, the contacting at 760 also may include interlocking the plate-facing alignment portion of the striker with the striker-facing alignment portion of the cover plate.

Illustrative, non-exclusive examples of inventive subject matter according to the present disclosure are described in the following enumerated paragraphs:

A1. A strike plate assembly that is configured to receive a bolt of a lock that is configured to retain a door, the strike plate assembly comprising:

a cover plate that defines a lock-facing side, an opposed striker-facing side, and a striker opening that extends between the lock-facing side and the striker-facing side;

a striker that defines a bolt receptacle that is sized to receive the bolt, wherein the striker opening is larger than the bolt receptacle, and further wherein the bolt receptacle is aligned within the striker opening to define a bolt-receiving portion of the strike plate assembly;

an alignment structure that aligns the striker with the cover plate to define a plurality of orientations of the bolt receptacle relative to the striker opening, wherein the bolt receptacle is accessible to the bolt via the striker opening, and further wherein the striker-facing side of the cover plate generally faces toward the striker and the alignment structure; and a fastening structure that selectively retains the bolt receptacle in a selected orientation of the plurality of orientations.

A2. The assembly of paragraph A1, wherein the assembly further defines a void space that is at least partially defined by the cover plate and the striker.

A3. The assembly of paragraph A2, wherein the void space extends (at least partially) between the alignment structure and the bolt-receiving portion.

A4. The assembly of any of paragraphs A2-A3, wherein the alignment structure includes a striker-facing alignment portion that extends from the striker-facing side of the cover plate to define at least a portion of the void space.

A5. The assembly of any of paragraphs A2-A4, wherein the striker has a plate-facing side that faces generally toward the cover plate.

A6. The assembly of paragraph A5, wherein the alignment structure includes a plate-facing alignment portion that extends from the plate-facing side of the striker to define at least a portion of the void space.

A7. The assembly of any of paragraphs A5-A6, wherein the striker further defines a striker extension region that extends from the plate-facing side of the striker to define at least a portion of the void space.

A8. The assembly of any of paragraphs A2-A7, wherein the cover plate further defines a cover plate extension region that extends from the striker-facing side of the cover plate to define at least a portion of the void space.

A9. The assembly of any of paragraphs A1-A8, wherein the striker further defines a contact surface that is sized to extend (entirely) across a portion of the striker opening that is defined by the striker-facing side of the cover plate.

A10. The assembly of paragraph A9, wherein the contact surface surrounds the bolt receptacle.

A11. The assembly of any of paragraphs A9-A10, wherein the contact surface contacts the striker-facing side of the cover plate.

A12. The assembly of any of paragraphs A9-A11, wherein the contact surface restricts motion of particulate material between the contact surface and the striker-facing side of the cover plate.

A13. The assembly of any of paragraphs A1-A12, wherein the plurality of orientations permit selective translation of the striker relative to the cover plate in a first direction and in a second direction that is (at least substantially) perpendicular to the first direction to permit adjustment of a location of the bolt receptacle relative to the striker opening.

A14. The assembly of paragraph A13, wherein the first direction and the second direction are parallel to a plane that is defined by the striker-facing side of the cover plate.

A15. The assembly of any of paragraphs A1-A14, wherein the plurality of orientations includes a plurality of discrete orientations.

A16. The assembly of any of paragraphs A1-A15, wherein the alignment structure and the bolt-receiving portion are spaced apart from one another, optionally in a single direction.

A17. The assembly of any of paragraphs A1-A16, wherein the alignment structure is located to one side of the bolt-receiving portion.

A18. The assembly of any of paragraphs A1-A17, wherein the alignment structure does not surround the bolt-receiving portion.

A19. The assembly of any of paragraphs A1-A18, wherein the alignment structure includes a/the striker-facing alignment portion that is defined on the striker-facing side of the cover plate and a/the plate-facing alignment portion that is defined by the striker and interlocks with the striker-facing alignment portion to define the plurality of orientations.

A20. The assembly of paragraph A19, wherein the striker-facing alignment portion includes a plurality of cover plate serrations, and further wherein the plate-facing alignment portion includes a plurality of complementary striker serrations.

A21. The assembly of paragraph A20, wherein the plurality of cover plate serrations include at least one of (i) a plurality of linear cover plate serrations and (ii) a plurality of parallel cover plate serrations.

A22. The assembly of any of paragraphs A20-A21, wherein the plurality of striker serrations includes at least one of (i) a plurality of linear striker serrations and (ii) a plurality of parallel striker serrations.

A23. The assembly of any of paragraphs A20-A22, wherein a first portion of the plurality of cover plate serrations is oriented in a/the first direction, and further wherein a second portion of the plurality of cover plate serrations is oriented in a/the second direction that is perpendicular to the first direction.

A24. The assembly of paragraph A23, wherein the first portion of the plurality of cover plate serrations is spaced apart from the second portion of the plurality of cover plate serrations.

A25. The assembly of any of paragraphs A20-A24, wherein a first portion of the plurality of striker serrations is oriented in a/the first direction, and further wherein a second portion of the plurality of striker serrations is oriented in a/the second direction that is perpendicular to the first direction.

A26. The assembly of paragraph A25, wherein the first portion of the plurality of striker serrations is spaced apart from the second portion of the plurality of striker serrations.

A27. The assembly of any of paragraphs A1-A26, wherein the striker defines a plate-opposed side that faces away from the cover plate, and further wherein the assembly includes a back plate that is operatively attached to, or in contact with, at least a portion of the plate-opposed side of the striker.

A28. The assembly of paragraph A27, wherein the fastening structure includes a fastener, and further wherein the back plate receives the fastener to compress the striker between the back plate and the cover plate to retain the strike plate assembly in the selected orientation, and optionally wherein the back plate forms a portion of the fastening structure.

A29. The assembly of paragraph A28, wherein the back plate includes a fastener receptacle that receives the fastener.

A30. The assembly of any of paragraphs A28-A29, wherein the assembly includes a/the fastener receptacle that is operatively attached to the back plate and receives the fastener.

A31. The assembly of any of paragraphs A28-A30, wherein the fastener includes a threaded fastener, and further wherein the back plate includes a threaded receptacle that is sized to receive the threaded fastener.

A32. The assembly of any of paragraphs A1-A31, wherein the striker further defines an orientation adjustment opening, and further wherein the fastening structure includes a/the fastener that extends through the orientation adjustment opening.

A33. The assembly of paragraph A32, wherein the orientation adjustment opening is sized to permit the striker to translate relative to the fastener in a direction that is perpendicular to a longitudinal axis of the fastener.

A34. The assembly of any of paragraphs A32-A33, wherein the orientation adjustment opening is sized to permit the striker to translate relative to the fastener to permit the bolt receptacle and the striker opening to transition among the plurality of orientations.

A35. The assembly of any of paragraphs A1-A34, where the lock-facing side generally faces toward the lock when the bolt is received within the bolt receptacle.

A36. The assembly of any of paragraphs A1-A35, wherein the cover plate further defines a fastener opening that extends between the lock-facing side of the cover plate and the striker-facing side of the cover plate, and further wherein the fastening structure includes a/the fastener that extends through the fastener opening.

A37. The assembly of any of paragraphs A1-A36, wherein the cover plate further defines a mounting opening that extends between the lock-facing side of the cover plate and the striker-facing side of the cover plate, wherein the mounting opening is sized to receive a mounting device to permit mounting of the strike plate assembly on a structure.

A38. The assembly of any of paragraphs A1-A37 in combination with the bolt that extends from the lock, wherein the lock is located on the lock-facing side of the cover plate, and further wherein the bolt extends through the striker opening of the cover plate and is received within the bolt receptacle of the striker.

A39. The assembly of paragraph A38 in combination with the door that includes the lock.

A40. The assembly of paragraph A39 in combination with a compartment that includes the door.

A41. The assembly of paragraph A40 in combination with an aircraft that includes the compartment.

A42. The assembly of any of paragraphs A38-A41, wherein the assembly is at least one of:

(i) mounted on a threshold;

(ii) mounted on a floor; and (iii) mounted such that a plane that is defined by the lock-facing side is at least substantially parallel to a horizontal direction.

B1. A kit of components that is configured to be assembled to form a strike plate assembly, wherein the strike plate assembly is configured to receive a bolt of a lock that is configured to retain a door, the kit comprising:

a cover plate that defines a lock-facing side, an opposed striker-facing side, and a striker opening that extends between the lock-facing side and the striker-facing side;

a striker that defines a bolt receptacle that is sized to receive the bolt, wherein the striker opening is larger than the bolt receptacle, and further wherein the bolt receptacle is configured to be aligned within the striker opening to define a bolt-receiving portion of the strike plate assembly; and an alignment structure that is configured to align the striker with the cover plate to define a plurality of orientations of the bolt receptacle relative to the striker opening, wherein, when the striker is aligned with the cover plate, the bolt receptacle is accessible to the bolt via the striker opening and the striker-facing side of the cover plate generally faces toward the striker and the alignment structure.

B2. The kit of paragraph B1, wherein the kit further includes a fastening structure that is configured to retain the bolt receptacle in a selected orientation of the plurality of orientations.

B3. The kit of any of paragraphs B1-B2, wherein the kit further include any of the components and/or features of any of paragraphs A1-A42, whether in an assembled or in a disassembled configuration.

C1. A method of adjusting a location of a bolt receptacle of a strike plate assembly, wherein the strike plate assembly includes a cover plate that defines a striker opening, a striker that defines the bolt receptacle, an alignment structure that aligns the striker relative to the cover plate, and a fastening structure that operatively attaches the striker to the cover plate, and further wherein the bolt receptacle is sized to receive a bolt from a lock when the bolt passes through the striker opening and into the bolt receptacle, the method comprising:

loosening the fastening structure to permit motion of the striker relative to the cover plate, wherein the cover plate defines a lock-facing side that is configured to face the lock and a striker-facing side that is opposed to the lock-facing side and is configured to face the striker;

transitioning the bolt receptacle from a first orientation relative to the striker opening to a second orientation relative to the striker opening, wherein the transitioning includes accessing the striker plate from the lock-facing side of the cover plate, and optionally through the striker opening, to provide a motive force for the transitioning; and tightening the fastening structure to retain the bolt receptacle in the second orientation.

C2. The method of paragraph C1, wherein the strike plate assembly includes the strike plate assembly of any of paragraphs A1-A42.

C3. The method of any of paragraphs C1-C2, wherein the fastening structure operatively attaches the striker to the striker-facing side of the cover plate.

C4. The method of any of paragraphs C1-C3, wherein the loosening includes at least partially separating the striker from the striker-facing side of the cover plate.

C5. The method of any of paragraphs C1-C4, wherein the tightening includes contacting at least a portion of the striker with at least a portion of the striker-facing side of the cover plate.

C6. The method of any of paragraphs C1-05, wherein the method further includes maintaining the striker on the striker-facing side of the cover plate during the transitioning.

As used herein, the terms "selective" and "selectively," when modifying an action, movement, configuration, or other activity of one or more components or characteristics of an apparatus, mean that the specific action, movement, configuration, or other activity is a direct or indirect result of user manipulation of an aspect of, or one or more components of, the apparatus.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A strike plate assembly that is configured to receive a bolt of a lock that is configured to retain a door, the strike plate assembly comprising:

a cover plate that defines a lock-facing side, an opposed striker-facing side, and a striker opening that extends between the lock-facing side and the striker-facing side;

a striker that includes a striker extension region that extends from a cover plate-facing side of the striker, the striker extension region including a bolt receptacle entirely defined within the striker extension region, wherein the bolt receptacle is sized to receive the bolt, wherein the striker opening is larger than the bolt receptacle, such that the bolt receptacle is aligned within the striker opening to define a bolt-receiving portion of the strike plate assembly;

an alignment structure that aligns the striker with the cover plate to define a plurality of orientations of the bolt receptacle relative to the striker opening, wherein the bolt receptacle is accessible to the bolt via the striker opening, and further wherein the striker-facing side of the cover plate generally faces toward the striker and the alignment structure; and a fastening structure that selectively retains the bolt receptacle in a selected orientation of the plurality of orientations.

2. The assembly of claim 1, wherein the assembly further defines a void space that is at least partially defined by the cover plate and the striker, and further wherein the void space extends at least partially between the alignment structure and the bolt-receiving portion.

3. The assembly of claim 1, wherein the striker further defines a contact surface that is sized to extend across a portion of the striker opening that is defined by the striker-facing side of the cover plate.

4. The assembly of claim 3, wherein the contact surface entirely surrounds the bolt receptacle.

5. The assembly of claim 3, wherein the contact surface contacts the striker-facing side of the cover plate.

6. The assembly of claim 1, wherein the plurality of orientations permits selective translation of the striker relative to the cover plate in a first plurality of discrete orientations in a first direction and in a second plurality of discrete orientations in a second direction that is at least substantially perpendicular to the first direction to permit adjustment of a location of the bolt receptacle relative to the striker opening.

7. The assembly of claim 1, wherein the plurality of orientations include a plurality of discrete orientations.

8. The assembly of claim 1, wherein the alignment structure and the bolt-receiving portion are spaced apart from one another.

9. The assembly of claim 1, wherein the alignment structure is located to one side of the bolt-receiving portion.

10. The assembly of claim 1, wherein the alignment structure includes a striker-facing alignment portion that is defined on the striker-facing side of the cover plate and a plate-facing alignment portion that is defined by the striker and interlocks with the striker-facing alignment portion to define the plurality of orientations.

11. The assembly of claim 10, wherein the striker-facing alignment portion includes a plurality of cover plate serrations, and further wherein the plate-facing alignment portion includes a plurality of complementary striker serrations.

12. The assembly of claim 1, wherein the striker defines a plate-opposed side that faces away from the cover plate, and further wherein the assembly includes a back plate that is operatively attached to at least a portion of the plate-opposed side of the striker.

13. The assembly of claim 12, wherein the fastening structure includes a fastener, and further wherein the back plate receives the fastener to compress the striker between the back plate and the cover plate to retain the strike plate assembly in the selected orientation.

14. The assembly of claim 1, wherein the striker further defines an orientation adjustment opening, wherein the fastening structure includes a fastener that extends through the orientation adjustment opening, and further wherein the orientation adjustment opening is sized to permit the striker to translate relative to the fastener in a direction that is perpendicular to a longitudinal axis of the fastener.

15. The assembly of claim 1, where the lock-facing side of the cover plate generally faces toward the lock when the bolt is received within the bolt receptacle.

16. The assembly of claim 1 in combination with the bolt that extends from the lock, wherein the lock is located on the lock-facing side of the cover plate, and further wherein the bolt extends through the striker opening of the cover plate and is received within the bolt receptacle of the striker.

17. The assembly of claim 2, wherein the cover plate includes a cover plate extension region that extends from the striker-facing side of the cover plate, and further wherein the void space extends between the cover plate extension region and the striker extension region.

18. The assembly of claim 2, wherein at least one of the cover plate and the striker includes a relief region that defines the void space.

19. The assembly of claim 2, wherein the alignment structure includes a plate-facing alignment portion that extends from the cover plate-facing side of the striker to define at least a portion of the void space.

20. The assembly of claim 2, wherein the alignment structure includes a striker-facing alignment portion that extends from the striker-facing side of the cover plate to define at least a portion of the void space.

* * * * *